US005636568A

United States Patent [19]

Dugan

[11] Patent Number: 5,636,568

[45] Date of Patent: Jun. 10, 1997

[54] PLATE-TYPE PRINTING DEVICE AND METHOD OF USE

[75] Inventor: Jeffrey S. Dugan, Asheville, N.C.

[73] Assignee: BASF Corporation, Mount Olive, N.J.

[21] Appl. No.: 700,679

[22] Filed: Aug. 16, 1996

Related U.S. Application Data

[63] Continuation of Ser. No. 470,215, Jun. 6, 1995, abandoned.

[51] Int. Cl.[6] ..... B41M 1/14

[52] U.S. Cl. ..... 101/211; 101/128.4; 101/327; 101/368

[58] Field of Search ..... 101/211, 171, 101/202, 210, 327, 33, 34, 492, 128.4, 193, 405, 406, 360, 363, 364, 368

[56] References Cited

U.S. PATENT DOCUMENTS

| | | | |
|---|---|---|---|
| 2,132,086 | 10/1938 | Scheffler . | |
| 2,864,310 | 12/1958 | Nelson . | |
| 3,536,007 | 10/1970 | Harvey | 101/327 |
| 4,019,436 | 4/1977 | Handweiler | 101/492 |
| 4,516,496 | 5/1985 | Giori . | |
| 5,359,928 | 11/1994 | Blessington et al. | 101/128.4 |

FOREIGN PATENT DOCUMENTS

| | | | |
|---|---|---|---|
| 240208 | 5/1960 | Australia | 101/193 |
| 364275 | 9/1962 | Switzerland | 101/171 |

*Primary Examiner*—Eugene H. Eickholt
*Attorney, Agent, or Firm*—Depaoli & Frenkel, P.C.

[57] ABSTRACT

A plate-type printing device and a method of using same are disclosed, wherein the device is composed of a plurality of plates stacked in a front-to-back facial configuration, the plurality of plates containing: at least one inlet port for at least one colorant; at least one colorant-supply plate having formed on a front facial surface thereof at least one colorant-supply cavity disposed in fluid communication with the at least one inlet port; and at least one colorant-transfer plate having formed on a front facial surface thereof at least one colorant-transfer cavity shaped to form a first design pattern, the at least one colorant-transfer plate further containing at least one cavity-port formed in the at least one colorant-transfer cavity, the at least one cavity-port being disposed downstream of and in fluid communication with the at least one colorant-supply cavity.

29 Claims, 1 Drawing Sheet

PLATE-TYPE PRINTING DEVICE AND METHOD OF USE

This application is a continuation of application Ser. No. 470,215, filed Jun. 6, 1995 now abandoned.

BACKGROUND OF THE INVENTION

This invention relates to a plate-type printing device and a method of using same. More particularly, this invention relates to a plate-type multicolor printing device capable of printing a multicolored design in a single impression step.

Multicolor printing devices are known in the art. Reference is made, for example, to U.S. Pat. Nos. 2,864,310 to Nelson; 2,132,086 to Scheffler; and 4,516,496 to Giori.

A major drawback to conventional multicolor printing devices such as those disclosed in the foregoing references is that these devices require a separate plate or cylinder for each color to be supplied to an inking surface. The use of a separate plate or cylinder for each color tends to make these conventional printing devices relatively expensive and time-consuming to make, clean, re-use and/or replace. It would be desirable, therefore, to provide a multicolor printing device which does not require a separate plate or cylinder for each color to be supplied. It would be particularly desirable to provide a multicolor printing device which is relatively compact in design.

Another drawback to many conventional printing devices such as those disclosed in the Scheffler and Giori patents cited hereinabove is that ink is fed to the inking surface from a direction above or in front of the inking surface. In such an ink supply arrangement, ink replenishment of the inking surface generally requires manually and separately bringing each ink supply source in contact with the inking surface to transfer ink from the supply source to the inking surface. Such a step can be time-consuming and tends to make the printing system costlier and more complicated. Furthermore, the use of a plurality of separate ink supply sources and an inking source results in an undesirably bulky printing system. It would be desirable, therefore, to provide a printing device wherein ink can be continuously supplied to the inking surface. It would further be desirable to provide a relatively compact printing device wherein the ink supply source is composed of a single structure disposed to provide continuous ink replenishment to the inking surface.

The Nelson patent, cited hereinabove, discloses a printing device in which ink is fed to the inking surface from below, wherein the inking surface is disposed on an upper edge surface of a plate and the ink-supply source is disposed near the bottom edge of the plate. However, the Nelson printing device has a number of significant drawbacks.

For example, as mentioned previously herein, Nelson requires a separate plate for each color to be printed. The inking surface in the Nelson printing device is not divided into sections for different colored inks. For reasons given previously herein, it would be desirable to provide a printing device which does not require a separate plate for each color to be supplied.

In addition, in the Nelson printing device and method, ink is supplied to the inking surface by means of a relatively complicated labyrinth of channels, ducts, notches and holes. It would be desirable to provide a printing device wherein ink is supplied to the inking surface by means of a relatively simple channel arrangement.

In Nelson, the inking surface is disposed on an edge of a plate and is composed of a plurality of slots through which ink reaches the inking surface. Nelson teaches that the depth and width of these slots will determine the amount of color which is carried to the inking surface. Because the inking surface in Nelson is disposed on a plate edge, the width of these slots (and, consequently, the amount of ink reaching the inking surface) is limited by the thickness of the plate. In other words, the thinner the plate, the more narrow the slots on the inking surface (plate edge) and the less ink which can reach the inking surface. However, where a plate edge serves an the inking surface, the use of thicker plates also has drawbacks. For example, thicker plates limit the resolution of the image obtained because the thickness of the plates will define the minimum separation of pixels. The thicker the plates, the greater the distance between pixels and the lower the image resolution achieved. In addition, thick plates are more expensive to make and replace than are thin plates. Thick plates also result in a bulkier structure than do thin plates. Bulkier structures are generally more expensive and time-consuming to make, clean, inspect, re-use and/or inspect than are less bulky structures. Furthermore, thick plates are harder and more expensive to machine than are thin plates. It would be desirable, therefore, to provide a printing device wherein the amount of color reaching the inking surface is not limited by plate thickness.

In addition, it is continually desirable to provide a printing device and printing method wherein a multicolored print can be formed in a single impression with a single inking surface. Printing processes requiring more than one impression step have numerous drawbacks including, e.g., long drying periods between impression steps, differences in color register, waste of paper and other printed articles, waste of ink due to misprints, and reduced image sharpness of the first printed design.

A primary object of this invention is to provide a plate-type single-impression, multicolor printing device wherein ink is continuously fed to the inking surface from the back or bottom of the inking surface.

Another object of the present invention is to provide a plate-type single-impression, multicolor printing device wherein a single plate can supply a plurality of colored liquids to an inking surface.

A further object of the present invention is to provide a plate-type single-impression, multicolor printing device wherein a single surface of a single plate can supply a plurality of colored liquids to an inking surface.

A still further object of this invention is to provide a plate-type single-impression, multicolor printing device wherein a single plate can receive and be used to transfer a plurality of colored liquids.

Another object of this invention is to provide a plate-type single-impression, multicolor printing device wherein a single surface of a single plate can receive and be used to transfer a plurality of colored liquids.

A further object of this invention is to provide a plate-type single-impression, multicolor printing device wherein ink is supplied to the inking surface by means of a relatively simple channel design.

Another object of this invention is to provide a plate-type single-impression, multicolor printing device wherein the inking surface and the ink-supply source are disposed in a relatively compact structure.

A still further object of this invention is to provide a plate-type single-impression, multicolor printing device wherein the device is composed of relatively thin plates.

A further object of the present invention is to provide a method of single-impression, multicolor printing by means of a plate-type multicolor printing device having the characteristics set forth in the preceding objects.

These and other objects which are achieved according to the present invention can be readily discerned from the following description.

SUMMARY OF THE INVENTION

One aspect of the present invention is directed to a plate-type printing device containing a plurality of plates stacked in a front-to-back facial configuration, the plurality of plates containing:

at least one inlet port for at least one colorant;

at least one colorant-supply plate having formed on a front facial surface thereof at least one colorant-supply cavity disposed in fluid communication with the at least one inlet port; and at least one colorant-transfer plate having formed on a front facial surface thereof at least one colorant-transfer cavity shaped to form a first design pattern, the at least one colorant-transfer plate further containing at least one cavity-port formed in the at least one colorant-transfer cavity, the at least one cavity-port being disposed downstream of and in fluid communication with the at least one colorant-supply cavity.

A second aspect of the present invention is directed to a method of single-impression printing a design, preferably a multicolored design, by means of the plate-type printing device of this invention.

The plate-type printing device of this invention has a compact and simple design and is relatively less expensive and less time-consuming to make, clean, inspect, re-use and/or replace.

By feeding the colorant through one or more through-holes disposed in a back surface area of the colorant-transfer cavity or cavities, the printing device and method of this invention can provide continuous, non-manual colorant-replenishment of the colorant-transfer cavity or cavities.

DETAILED DESCRIPTION OF THE INVENTION

Figure 1B:
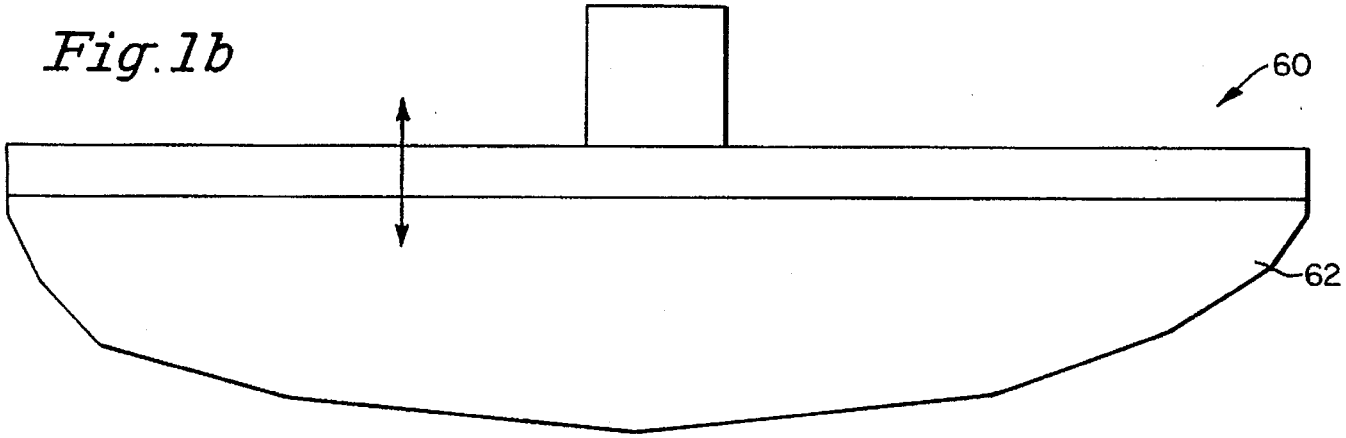
FIG. 1*b* represents a schematic illustration of a cross-sectional view of a printing pad useful for transferring a multicolored design from the printing device of this invention to a substrate to be printed.

The plate-type printing device of this invention is composed of a plurality of plates. The plurality of plates is composed of at least one colorant-supply plate and at least one colorant-transfer plate. In addition, as will be discussed in greater detail hereinbelow, the plurality of plates may further contain at least one intermediate plate.

The printing device of this invention contains at least one inlet port, wherein each colorant preferably enters the device by means of a separate inlet port. Preferably, the inlet port or ports are disposed in the colorant-supply plate(s), e.g., as shown in FIG. 1*a* herein.

The colorant-supply plate(s) has formed on a front facial surface thereof at least one colorant-supply cavity disposed in fluid communication with the at least one inlet port.

The at least one colorant-transfer plate has formed on a front facial surface thereof at least one colorant-transfer cavity shaped to form a first design pattern. The colorant-transfer plate(s) further contains at least one cavity-port formed in the at least one colorant-transfer cavity, wherein the cavity-port(s) is disposed downstream of and in fluid communication with the at least one colorant-supply cavity. A colorant will flow into the colorant-transfer cavity by means of the cavity-port(s) formed in the colorant-transfer cavity. Each colorant-transfer cavity will contain at least one cavity-port.

Preferably, the printing device of this invention will contain a plurality of inlet ports, a plurality of colorant-supply cavities, and a plurality of colorant-transfer cavities, and the method of this invention will involve the use of a plurality of colorants.

The colorant-transfer plate(s) and the colorant-supply plate(s) may be stacked together in a front-to-back facial configuration. In this embodiment, the colorant or colorants will preferably flow directly from the colorant-supply cavity or cavities into the corresponding colorant-transfer cavity or cavities through the cavity-port or ports formed in the colorant-transfer cavity or cavities.

Alternatively, the colorant-transfer plate(s) and the colorant-supply plate(s) may be separated from one another by at least one intermediate plate disposed between and in fluid communication with the colorant-supply and colorant-transfer cavities. The at least one intermediate plate contains at least one through-hole disposed in fluid communication with a colorant-supply cavity and with a colorant-transfer cavity. The through-hole serves as a passageway for a colorant passing from a colorant-supply cavity to a colorant-transfer plate.

In some instances, it may be desired to supply two or more colorants from two or more colorant-supply cavities to two or more colorant-transfer cavities, wherein one or more of the colorant-supply cavities is not disposed directly beneath a corresponding colorant-transfer cavity or cavities (i.e., corresponding colorant-supply and colorant-transfer cavities are disposed at an angle from one another) such that colorant-directing through-holes connecting respective colorant-supply and colorant-transfer cavities would have to cross one another if disposed in a single plate. Since it is desired that colorants disposed in respective cavities and through-holes not be intermingled with one another, it is preferred that at least one intermediate plate be disposed between and in fluid communication with the colorant-supply and colorant-transfer cavities. More preferably, at least two intermediate plates will be disposed between the colorant-supply plate and the colorant-transfer plate. A first intermediate plate preferably has formed on a front facial surface thereof a flow-transfer channel disposed in fluid communication with a first colorant-supply cavity and a first colorant-transfer cavity. A second intermediate plate preferably contains a through-hole disposed in fluid communication with a second colorant-supply cavity and a second colorant-transfer cavity.

As mentioned hereinabove, each colorant-transfer cavity has formed therein at least one cavity-port. The cavity-port (s) permits flow of the colorant into the colorant-transfer cavity. By means of the cavity-port(s), each cavity is able to be fed or replenished from below, i.e., from an upstream direction. This permits continuous, non-manual, replenishment of the colorant-transfer cavity or cavities.

In the printing device of this invention, the colorant-transfer cavity forms or the plurality of mutually separated colorant-transfer cavities form a first design pattern. When a first substrate is placed on the one or more colorant-transfer cavities, colorant liquid portions will be transferred from the cavity or cavities to the first substrate to form thereon a second design pattern which is a substantial mirror image of the first design pattern.

Because each colorant-transfer cavity is separate from and not in fluid communication with each other, each cavity contributes a separate and distinct feature to the first design pattern. Each cavity may be filled with a colorant of the same color or with a colorant of a different color.

In general, in the operation of the printing device of this invention, one or more colorant liquids are introduced, via the one or more inlet ports, into the one or more colorant-supply cavities formed in the colorant-supply flow plate(s) and then conducted to the one or more colorant-transfer cavities formed in the colorant-transfer flow plate(s).

In the device and method of the present invention, the colorant(s) may be conducted from the colorant-supply cavity or cavities to the colorant-transfer cavity or cavities by a variety of means. For example, in embodiments wherein the only plates present in the device are the colorant-transfer and colorant-supply flow plates, a colorant is introduced directly from a colorant-supply cavity in the colorant-supply flow plate to a colorant-transfer cavity in the colorant-transfer flow plate by means of the through-hole(s) formed in the colorant-transfer cavity.

In alternative embodiments, one or more non-functional plates may be disposed between the colorant-transfer and colorant-supply flow plates, the non-functional plates containing appropriate through-holes formed therein to conduct the colorant(s) from the colorant-supply cavity or cavities to the corresponding color-transfer cavity or cavities.

As stated previously herein, preferred embodiments of the printing device and method of the present invention use a plurality of colorant liquids, a plurality of inlet ports, a plurality of colorant-supply cavities and a plurality of colorant-transfer cavities. More preferably, the printing device of this invention will have a separate inlet port or ports, a separate colorant-supply cavity or cavities, and a separate colorant-transfer cavity or cavities for each colorant liquid of a different color.

If the colorant-supply cavity or cavities in the printing device of this invention is formed in the back facial surface of a colorant-supply flow plate(s), the colorant-supply flow plate(s) preferably contains one or more through-holes (i.e., one through-hole for each colorant-supply cavity) through which the colorant liquid(s) passes to reach the through-hole(s) formed in the colorant-transfer cavity or cavities disposed in the colorant-transfer flow plate(s).

If the colorant-transfer and colorant-supply flow plate(s)s are each in the form of a cylinder, the inlet port or ports may each be in the form of a through-hole extending from an exterior surface region of the colorant-transfer flow plate(s) or the colorant-supply flow plate(s) through to the surface on which the colorant-supply cavity or cavities is formed.

The colorant liquid(s) can be forced from the colorant-supply cavity or cavities to the colorant-transfer cavity or cavities via the colorant-directing flow channels and through-holes (and other through-holes and colorant-flow channels, if present, as described previously herein) by means of pressure, centrifugal force, capillary action and the like, with pressure being the most preferred means.

In the printing device of this invention, the printer plates, as well as the non-functional plates, are thin, with each plate preferably having a thickness of from about 0.001 inch to about 1.0 inch, more preferably from about 0.01 inch to about 0.25 inch, and most preferably from about 0.01 inch to about 0.10 inch.

Each colorant-transfer cavity and each colorant-supply cavity preferably has a depth of from about 10% to about 80%, more preferably from about 30% to about 70%, of the depth of the colorant-transfer and colorant-supply flow plate(s), respectively.

The printer and non-functional plates can be composed of metallic or non-metallic material. Suitable non-metals include, e.g., thermoplastic resins. Suitable metals include, e.g., stainless steel, aluminum, aluminum-based alloys, nickel, iron, copper, copper-based alloys, mild steel, brass, titanium and other micromachinable metals.

The plates may have any suitable shape. For example, the plates can be square, rectangular, round and the like. Furthermore, the plates can be flat or curved such as in a cylinder- or roller-like configuration. The particular shape and configuration of the plates used in the present invention will depend on the application in which the printing device is used.

The colorant-transfer cavity or cavities, the through-holes, the colorant-supply cavity or cavities, and the inlet port or ports are preferably formed by means of a micromachining process. Non-limiting examples of suitable micromachining processes include etching, stamping, punching, pressing, cutting, molding, milling, lithographing, and particle blasting. Most preferably, the micromaching process is an etching process. Etching, e.g., photochemical etching, provides precisely formed cavities and channels while being less expensive than many other conventional machining processes. Furthermore, etched perforations generally do not have the sharp corners, burrs, and sheet distortions associated with mechanical perforations. Etching processes are well known in the art and are typically carried out by contacting a surface with a conventional etchant.

In the printing device of this invention, at least one set of plates is disposed in a front-to-back facially stacked configuration. The at least one set of plates is composed of at least one colorant-transfer flow plate and at least one colorant-supply flow plate and any intervening plates as may be desired. The device may contain additional sets of plates, wherein the additional sets are stacked end-to-end or side-by-side with respect to the first set of plates.

The printing device of this invention is preferably oriented in a horizontal direction.

The present invention is also directed to a method of printing a design pattern onto a substrate by means of the plate-type printing device of this invention. The method of this invention involves the steps of:

- introducing the at least one colorant into the at least one colorant-supply cavity through the at least one inlet port;
- directing the at least one colorant from the at least one colorant-supply cavity to the at least one cavity-port disposed in the at least one colorant-transfer cavity; and
- applying a first substrate onto the at least one colorant-transfer cavity to transfer at least a portion of the at least one colorant disposed in the at least one colorant-transfer cavity, the portion forming a second design pattern which is a substantial mirror image of the first design pattern.

In pad printing applications, the method of this invention further includes the step of applying the first substrate having the second design pattern formed thereon onto a second substrate to print a third design pattern onto the second substrate, the third design pattern being substantially identical to the first design pattern and a substantial mirror image of the second design pattern.

The colorant liquid used in the present invention is preferably either an ink or a dye, more preferably an ink.

Substrates which can be printed by means of the printing device and method of this invention can comprise any of the conventional substrates on which color images can be printed. For example, the substrate may comprise paper, fabric, plastic or metal, e.g., stainless steel. If the substrate is composed of a paper, plastic or fabric, the colorant-transfer and colorant-supply flow plate(s)s are preferably in the form of a cylinder.

The present invention will now be described by reference to FIG. 1 herein.

Figure 1A:
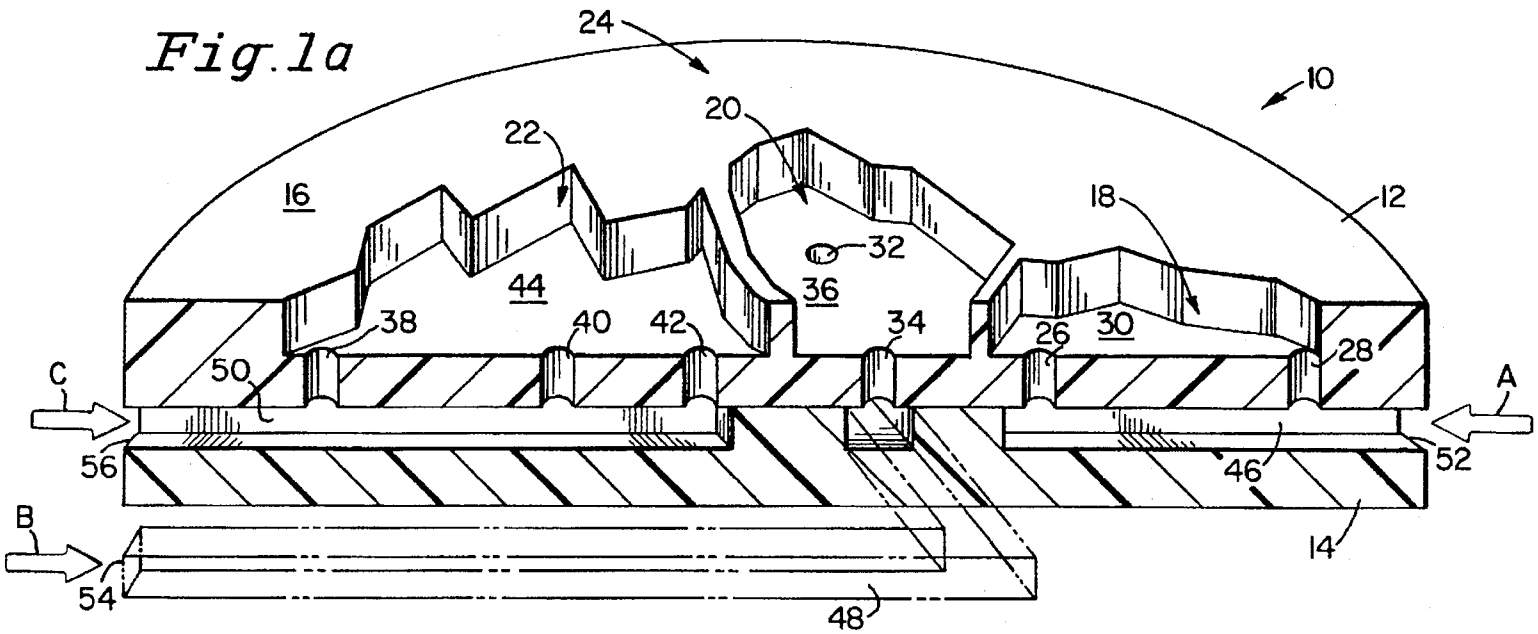
FIG. 1*a* represents a schematic illustration of a cross-sectional view of a plate-type printing device within the scope of the present invention which can be used in conjunction with a printing pad represented in FIG. 1*b*.

FIG. 1*a* illustrates a plate-type printing device within the scope of this invention, while FIG. 1*b* illustrates a pad which can be used in a pad printing process with the printing device shown in FIG. 1*a*.

In FIG. 1*a*, a horizontally-oriented plate-type printing device 10 contains a colorant-transfer plate 12 and a colorant-supply plate 14. Colorant-transfer plate 12 is disposed on a front facial surface (not shown) of the colorant-supply plate 14. Formed on a front facial surface 16 of colorant-transfer plate 12 are three colorant-transfer cavities, 18, 20 and 22. The cavities together form a design pattern 24, to which each cavity contributes a separate and distinct design element corresponding to the shape of the respective cavities.

Colorant-transfer cavity 18 is composed of two cavity-ports 26 and 28 formed in a bottom portion 30 of cavity 18; second colorant-transfer cavity 20 has two cavity-ports 32 and 34 formed in a bottom portion 36 thereof; and third colorant-transfer cavity 22 has three cavity-ports 38, 40 and 42 formed in a bottom portion 44 thereof.

Colorant-supply plate 14 has formed on the front facial surface thereof three colorant-supply cavities 46, 48 and 50 and three inlet ports 52, 54 and 56 for passage therethrough of three colorant liquids of differing color, "A", "B" and "C". First-color colorant liquid A flows via inlet port 52 to colorant-supply cavity 46, then through through-holes 26 and 28 into colorant-transfer cavity 18. Second-color colorant liquid B flows through inlet port 54 into colorant-supply cavity 48, then through through-holes 32 and 34 into colorant-transfer cavity 20. Third-color colorant liquid C flows through inlet port 56 into colorant-supply cavity 50, then through through-holes 38, 40 and 42 into colorant-transfer cavity 22.

FIG. 1*b* illustrates a pad device which can be used in conjunction with the printing device shown in FIG. 1*a* in a pad printing process within the scope of the present invention. Pad device 60 is composed of a resilient, absorbent polymeric pad portion 62 which is pressed down in the direction of the arrow onto surface 16 of plate 12. Portions (not shown) of colorant liquids A–C are transferred to pad portion 62 from colorant-transfer cavities 18, 20 and 22. The portions form a second design pattern (not shown) substantially identical to the first design pattern 24. Pad device 60 with pad portion 62 having the second design pattern formed thereon is then applied, preferably with pressure, against a substrate (not shown) to print on the substrate a third design pattern (not shown) which is substantially identical to the second design pattern.

Although the present invention has been described with reference to preferred embodiments, those skilled in the art will recognize that changes may be made in form and detail without departing from the spirit and scope of the invention.

What is claimed is:

1. A plate-type printing device, comprising a plurality of plates stacked in a front-to-back facial configuration, said plurality of plates comprising:

(i) at least one colorant-supply plate having formed on a front facial surface thereof at least one colorant-supply cavity;

(ii) at least one colorant-transfer plate having formed on a front facial surface thereof at least one colorant-transfer cavity shaped to form a first design pattern, said at least one colorant-transfer plate further comprising at least one colorant-directing through-hole passage extending from said front facial surface of said at least one colorant-transfer plate through said at least one colorant-transfer plate to an opposite back facial surface of said at least one colorant-transfer plate, wherein said at least one colorant-transfer cavity comprises at least one through-hole opening formed therein, said at least one through-hole opening being a terminal end of one of said at least one colorant-directing through-hole passage, said at least one colorant-directing through-hole passage being disposed downstream of and in fluid communication with said at least one colorant-supply cavity; and (iii) at least one inlet channel for delivering at least one colorant to said at least one colorant-supply plate and said at least one colorant-transfer plate, wherein said at least one inlet channel is formed on said front facial surface of said at least one colorant-supply plate and is disposed in fluid communication with said at least one colorant-supply cavity.

2. A printing device according to claim 1, wherein said colorant-transfer plate and said colorant-supply plate are stacked in a front-to-back facial configuration.

3. A printing device according to claim 1, further comprising at least one intermediate plate disposed between and in fluid communication with said colorant-supply plate and said colorant-transfer plate, said at least one intermediate plate comprising at least one through-hole disposed for flow therethrough of at least one colorant as said colorant is passed from at least one colorant-supply cavity formed in said colorant-supply plate to at least one through-hole opening formed in said colorant-transfer plate.

4. A printing device according to claim 1, comprising a plurality of said at least one inlet channel, a plurality of said at least one colorant-supply cavity, a plurality of said at least one colorant-transfer cavity, a plurality of said at least one colorant-directing through-hole passage, and a plurality of said at least one through-hole opening.

5. A printing device according to claim 4, further comprising at least two intermediate plates disposed between said colorant-supply plate and said colorant-transfer plate, wherein a first intermediate plate has formed on a front facial surface thereof a flow-transfer channel disposed in fluid communication with a first colorant-supply cavity and with a first colorant-transfer cavity, further wherein a second intermediate plate comprises a through-hole disposed in fluid communication with a second colorant-supply cavity and with a second colorant-transfer cavity.

6. A printing device according to claim 1, wherein each of said plates has a thickness of from about 0.001 inch to about 1.0 inch.

7. A printing device according to claim 6, wherein each of said plates has a thickness of from about 0.01 inch to about 0.10 inch.

8. A printing device according to claim 1, wherein said at least one colorant-transfer cavity has a depth of from about 10% to about 80% of a depth of said colorant-transfer plate, and said at least one colorant-supply cavity has a depth of from about 10% to about 80% of a depth of said colorant-supply plate.

9. A printing device according to claim 1, wherein said at least one colorant-transfer cavity and said at least one colorant-supply cavity are formed by a micromachining process.

10. A printing device according to claim 9, wherein said micromachining process comprises etching.

11. A printing device according to claim 1, wherein each of said plates comprises a metal.

12. A printing device according to claim 1, wherein each of said plates comprises a non-metal.

13. A method for single-impression printing a design onto a substrate surface by means of a plate-type printing device comprising a plurality of plates stacked in a front-to-back facial configuration, said plurality of plates comprising:

(i) at least one colorant-supply plate having formed on a front facial surface thereof at least one colorant-supply cavity;

(ii) at least one colorant-transfer plate having formed on a front facial surface thereof at least one colorant-transfer cavity shaped to form a first design pattern, said at least one colorant-transfer plate further comprising at least one colorant-directing through-hole passage extending from said front facial surface of said at least one colorant-transfer plate through said at least one colorant-transfer plate to an opposite back facial surface of said at least one colorant-transfer plate, wherein said at least one colorant-transfer cavity comprises at least one through-hole opening formed therein, said at least one through-hole opening being a terminal end of one of said at least one colorant-directing through-hole passage, said at least one colorant-directing through-hole passage being disposed downstream of and in fluid communication with said at least one colorant-supply cavity; and (iii) at least one inlet channel for delivering at least one colorant to said at least one colorant-supply plate and said at least one colorant-transfer plate, wherein said at least one inlet channel is formed on said front facial surface of said at least one colorant-supply plate and is disposed in fluid communication with said at least one colorant-supply cavity;

wherein said method comprises the steps of:

introducing the at least one colorant into the at least one colorant-supply cavity through the inlet channel;

directing the at least one colorant from the at least one colorant-supply cavity through said at least one colorant-directing through-hole passage to said at least one through-hole opening disposed in said at least one colorant-transfer cavity; and applying a first substrate onto the at least one colorant-transfer cavity to transfer at least a portion of said at least one colorant disposed in said at least one colorant-transfer cavity, said portion forming a second design pattern which is a substantial mirror image of said first design pattern.

14. A method according to claim 13, wherein said at least one colorant comprises an ink or a dye.

15. A method according to claim 14, wherein said first substrate comprises paper, plastic or fabric.

16. A method according to claim 13, further comprising the step of applying said first substrate having said second design pattern formed thereon onto a second substrate to print a third design pattern onto said second substrate, said third design pattern being substantially identical to said first design pattern and being a substantial mirror image of said second design pattern.

17. A method according to claim 16, wherein said first substrate comprises a colorant absorbent polymeric pad.

18. A method according to claim 17, wherein said second substrate comprises paper, plastic or fabric.

19. A method according to claim 13, wherein said colorant-transfer plate and said colorant-supply plate are stacked in a front-to-back facial configuration.

20. A method according to claim 13, further comprising at least one intermediate plate disposed between and in fluid communication with said colorant-supply plate and said colorant-transfer plate, said at least one intermediate plate comprising at least one through-hole disposed for flow therethrough of at least one colorant as said colorant is passed from at least one colorant-supply cavity formed in said colorant-supply plate to at least one through-hole opening formed in said colorant-transfer plate.

21. A method according to claim 13, comprising a plurality of said at least one inlet channel, a plurality of said at least one colorant-supply cavity, a plurality of said at least one colorant-transfer cavity, a plurality of said at least one colorant-directing through-hole passage, and a plurality of said at least one through-hole opening.

22. A method according to claim 21, further comprising at least two intermediate plates disposed between said colorant-supply plate and said colorant-transfer plate, wherein a first intermediate plate has formed on a front facial surface thereof a flow-transfer channel disposed in fluid communication with a first colorant-supply cavity and with a first colorant-transfer cavity, further wherein a second intermediate plate comprises a through-hole disposed in fluid communication with a second colorant-supply cavity and with a second colorant-transfer cavity.

23. A method according to claim 13, wherein each of said plates has a thickness of from about 0.001 inch to about 1.0 inch.

24. A method according to claim 23, wherein each of said plates has a thickness of from about 0.01 inch to about 0.10 inch.

25. A method according to claim 13, wherein said at least one colorant-transfer cavity has a depth of from about 10% to about 80% of a depth of said colorant-transfer plate, and said at least one colorant-supply cavity has a depth of from about 10% to about 80% of a depth of said colorant-supply plate.

26. A method according to claim 13, wherein said at least one colorant-transfer cavity and said at least one colorant-supply cavity are formed by a micromachining process.

27. A method according to claim 26, wherein said micromachining process comprises etching.

28. A method according to claim 13, wherein each of said plates comprises a metal.

29. A method according to claim 13, wherein each of said plates comprises a non-metal.

* * * * *